US007014226B1

(12) United States Patent
Huang

(10) Patent No.: US 7,014,226 B1
(45) Date of Patent: Mar. 21, 2006

(54) ELECTROMAGNETIC LOCK DEVICE

(75) Inventor: Chien Ying Huang, Taichung (TW)

(73) Assignee: Soca Technology Co., Ltd., Taichung (TW)

( * ) Notice: Subject to any disclaimer, the term of this patent is extended or adjusted under 35 U.S.C. 154(b) by 0 days.

(21) Appl. No.: 10/932,160

(22) Filed: Sep. 1, 2004

(51) Int. Cl.
*E05C 1/06* (2006.01)
*E05B 47/02* (2006.01)

(52) U.S. Cl. ..... 292/144; 292/163; 70/280

(58) Field of Classification Search ..... 70/279.1, 70/277, 280; 292/144, 251.5, 201, 163, 244
See application file for complete search history.

(56) References Cited

U.S. PATENT DOCUMENTS 2,798,751 A * 7/1957 Walden ..... 292/144
4,237,711 A * 12/1980 Kambic ..... 70/150
4,557,121 A * 12/1985 Charlton ..... 70/279.1
4,579,376 A * 4/1986 Charlton ..... 292/144
4,593,543 A * 6/1986 Stefanek ..... 292/144
4,677,834 A * 7/1987 Hicks ..... 292/144
5,009,456 A * 4/1991 Eck ..... 292/144
5,100,184 A * 3/1992 Schmitt ..... 292/144
5,177,988 A * 1/1993 Bushnell ..... 70/279.1
5,246,258 A * 9/1993 Kerschenbaum et al. .. 70/279.1
5,511,832 A * 4/1996 Kunzel ..... 292/144
5,531,086 A 7/1996 Bryant ..... 70/279
5,823,026 A * 10/1998 Finke ..... 70/279.1
6,079,755 A 6/2000 Chang ..... 292/144
6,112,563 A * 9/2000 Ramos ..... 292/144
6,302,455 B1 * 10/2001 Huang ..... 292/201

* cited by examiner

*Primary Examiner*—Brian E. Glessner
*Assistant Examiner*—Christopher Boswell
(74) *Attorney, Agent, or Firm*—Charles E. Baxley

(57) ABSTRACT

An electromagnetic lock device includes a receptacle, a deadbolt slidably engaged in the receptacle and extendible out of the receptacle, for locking a door panel to a door frame, a shaft attached to one end of the deadbolt. A housing is attached to the receptacle, and includes a plunger core slidably received in a coil and actuatable by the coil and having a pin. An elbow includes an arm pivotally secured to the receptacle, an opening formed in an intermediate connecting portion to slidably receive the pin, and another arm having an oblong hole to slidably receive the shaft, and to allow the deadbolt to be forced in and out of the receptacle by the plunger core via the elbow. A spring member may bias the plunger core out of the housing, when the coil is not energized.

8 Claims, 8 Drawing Sheets

ELECTROMAGNETIC LOCK DEVICE

BACKGROUND OF THE INVENTION

1. Field of the Invention

The present invention relates to an electromagnetic lock device, and more particularly to an electromagnetic lock device having a solidly coupling mechanism to effectively actuate a latch or a deadbolt to lock door panels.

2. Description of the Prior Art

Various kinds of typical electromagnetic lock devices have been developed and comprise a moving member slidably received in a housing, and coupled to a deadbolt, for actuating the deadbolt to lock door panels.

For example, U.S. Pat. No. 5,531,086 to Bryant discloses one of the typical electromagnetic lock devices and also comprising a moving member slidably received in a housing, and coupled to a deadbolt via a connecting rod and a torque blade key, for actuating the deadbolt to lock door panels.

In Bryant, the moving member and the deadbolt and the connecting rod are all parallel to the housing, and the torque blade key is rotatably attached to a latch frame and coupled between the deadbolt and the connecting rod, to allow the deadbolt to be actuated by an electromagnetic actuating device via the connecting rod. The deadbolt may not be moved in a direction perpendicular to the moving member and the housing.

U.S. Pat. No. 6,079,755 to Chang discloses another typical electromagnetic lock device comprising a deadbolt or a latch slidable in a direction perpendicular to a spindle or a plunger core of an electromagnetic actuating device, coupled to the plunger core via a rotatable follower.

However, the rotatable follower includes an arm having a head formed in a free end thereof and engaged into a recess of the latch, to move the latch into and out of an outer housing, and to lock or unlock the door panels. The head of the arm of the follower has not be solidly coupled to the latch and may have a good chance to slip relative to the latch.

The present invention has arisen to mitigate and/or obviate the afore-described disadvantages of the conventional electromagnetic lock devices.

SUMMARY OF THE INVENTION

The primary objective of the present invention is to provide an electromagnetic lock device including a solidly coupling mechanism to effectively actuate a latch or a deadbolt to lock door panels.

In accordance with one aspect of the invention, there is provided an electromagnetic lock device comprising an outer cover for attaching to a door panel, a receptacle secured to the outer cover, and including a chamber formed therein, a deadbolt slidably engaged in the chamber of the receptacle, and extendible out of the receptacle, for locking the door panel to a door frame, and the deadbolt including a first end having a shaft attached thereto, a housing attached to the receptacle, and including a chamber formed therein, a coil received in the housing, a plunger core slidably received in the coil and the housing, and movable and actuatable by the coil, and including a first end having a pin attached thereto, an elbow including a first and a second arms secured together, and having an intermediate connecting portion, the first arm including a first end pivotally secured to the receptacle with an axle, to allow the elbow to be rotated relative to the receptacle. The elbow includes an opening formed in the intermediate connecting portion thereof to slidably receive the pin of the plunger core, and to allow the elbow to be rotated relative to the receptacle by the plunger core, the second arm includes an oblong hole formed therein to slidably receive the shaft of the deadbolt, and to allow the deadbolt to be forced to move in and out of the receptacle by the plunger core via the elbow, and a spring member may further be provided and engaged with the plunger core, to bias the plunger core out of the housing, and to force the deadbolt to move into the receptacle when the coil is not energized. The plunger core may be solidly coupled to the deadbolt with the elbow to allow the deadbolt to be effectively actuated or moved by the plunger core.

The deadbolt includes a slot formed in the first end thereof, the shaft is secured to the first end of the deadbolt, and extended through the slot of the deadbolt.

The plunger core includes a channel formed in the first end thereof, to slidably receive the intermediate connecting portion of the elbow, the pin is secured to the first end of the plunger core, and extended through the channel of the plunger core.

The plunger core includes a hollow cavity formed therein, for weight reducing purposes.

An electric circuit board may further be provided and attached to the receptacle, and including a switch disposed thereon, the elbow including an actuating finger extended therefrom and located close to the switch, for actuating the switch, to detect whether the elbow is rotated relative to the receptacle and to actuate the deadbolt out of the receptacle or not. The switch includes a pressing knob disposed thereon for being depressed by the actuating finger of the elbow.

A follower may further be provided and secured to the plunger core, and a lock device including an actuating tongue extended therefrom and engageable with the follower, for selectively moving the plunger core into the housing, and to force the deadbolt into the receptacle by the elbow, such that the electromagnetic lock device may also be actuated or unlocked by the users manually with the lock device, in addition to the electromagnetic mechanism formed by the coil and the plunger core.

A casing may further be provided and secured to the outer cover, the casing including a bore formed therein to slidably receive the follower therein. The opening of the elbow is preferably an irregular opening for slidably receiving the pin of the plunger core, and for allowing the pin to be slid relative to the elbow.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 4:
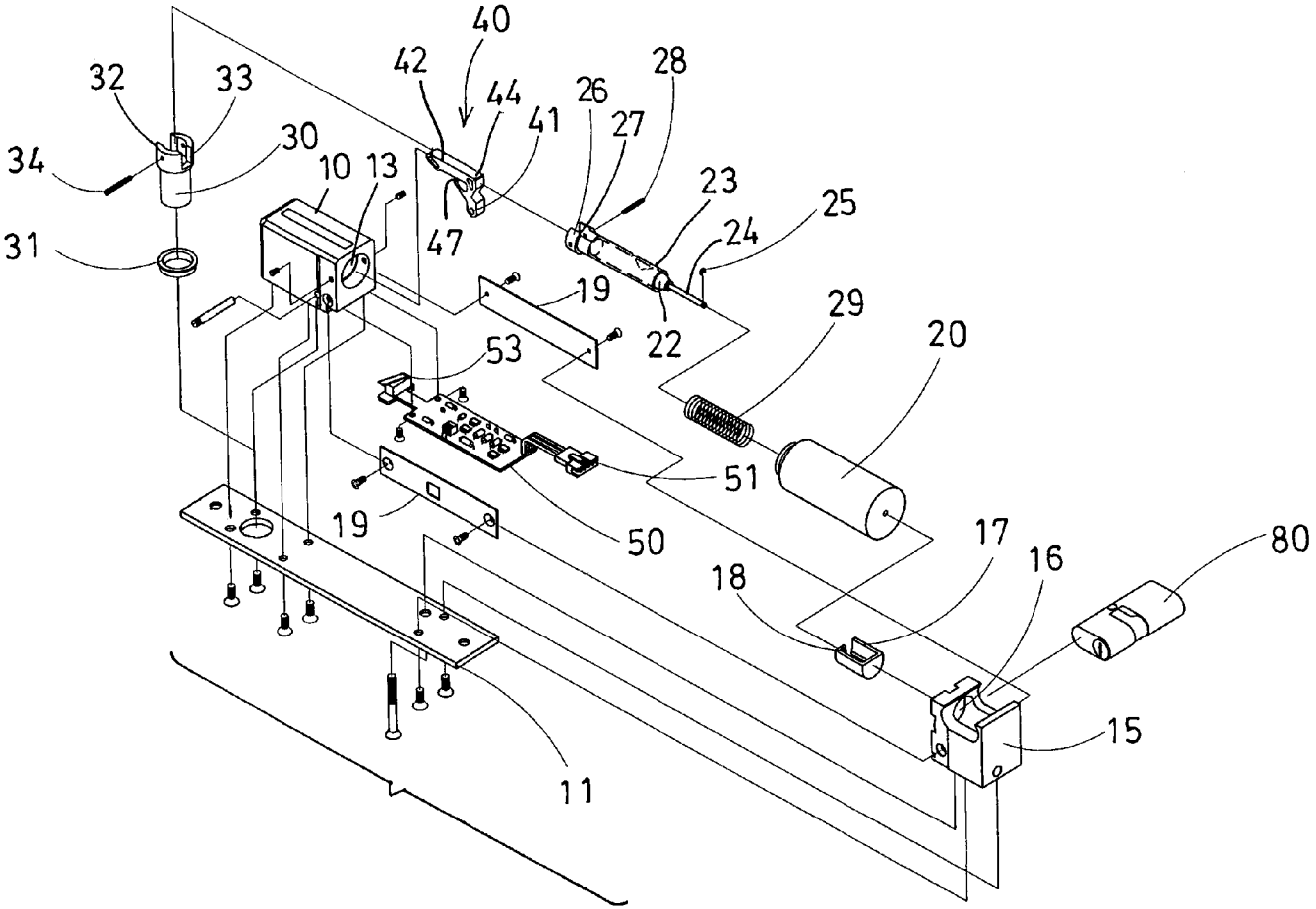
FIG. 4 is another partial exploded view of the electromagnetic lock device.

Referring to the drawings, and initially to FIGS. 1–4, an electromagnetic lock device in accordance with the present invention comprises a receptacle 10 to be engaged into a door panel 90, and secured to an outer cover 11 which may be secured to the door panel 90, to solidly secure or retain the receptacle 10 in the door panel 90. The receptacle 10 includes a chamber 12 formed therein and having an open end 13 (FIG. 4).

Figure 5:
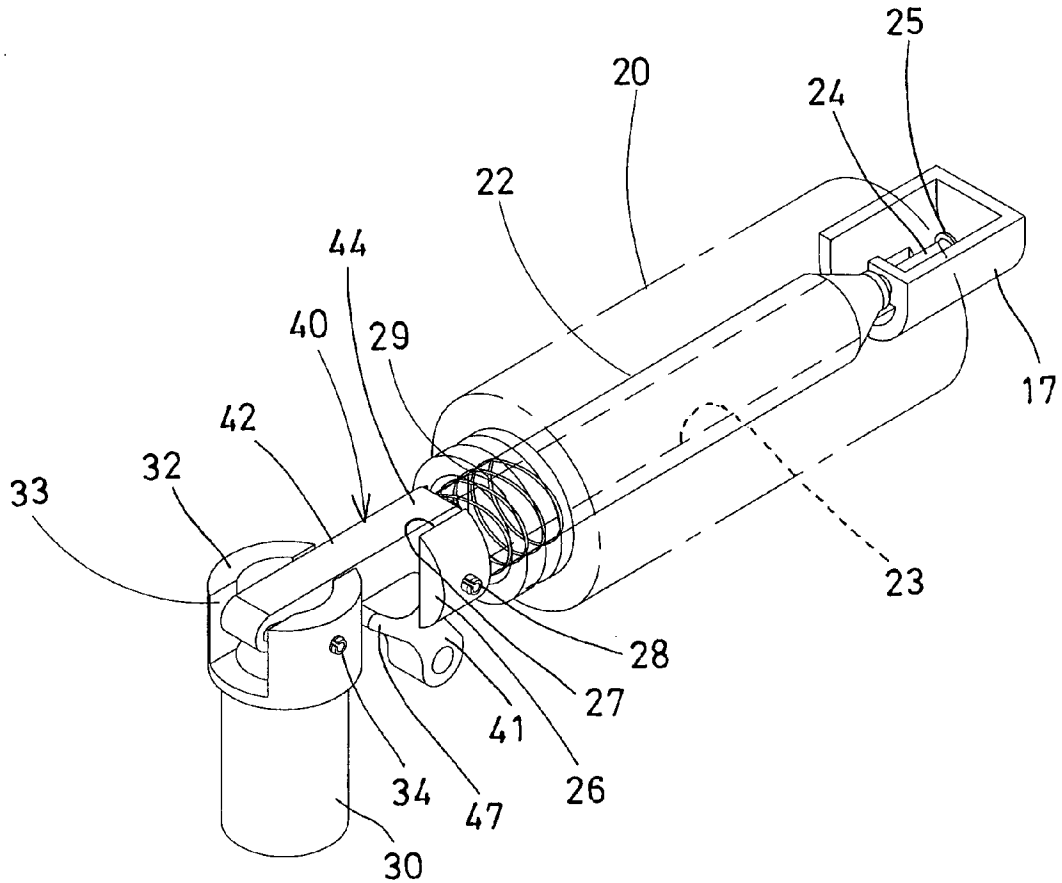
FIG. 5 is a perspective view showing a portion of the electromagnetic lock device.
Figure 6:
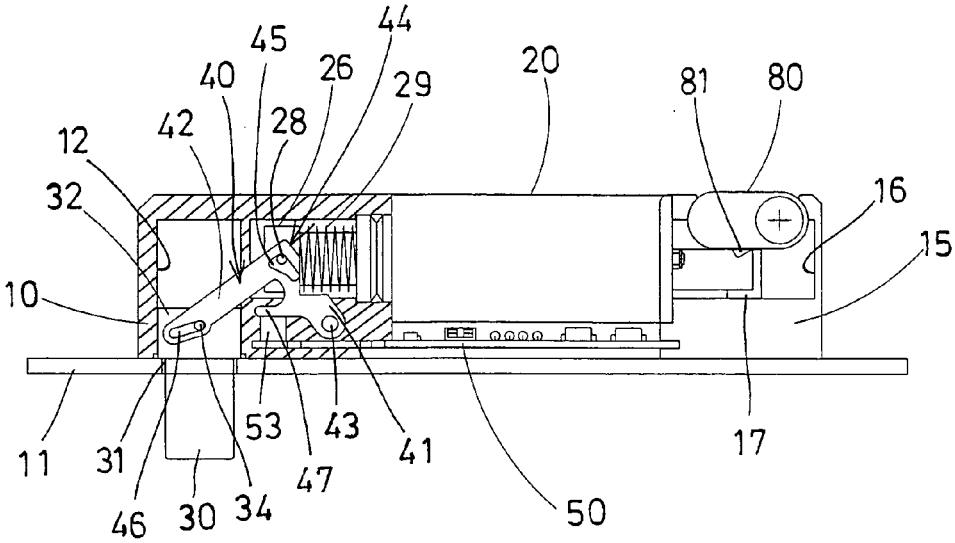
FIG. 6 is a partial cross sectional view taken along lines 6—6 of FIG. 3.
Figure 7:
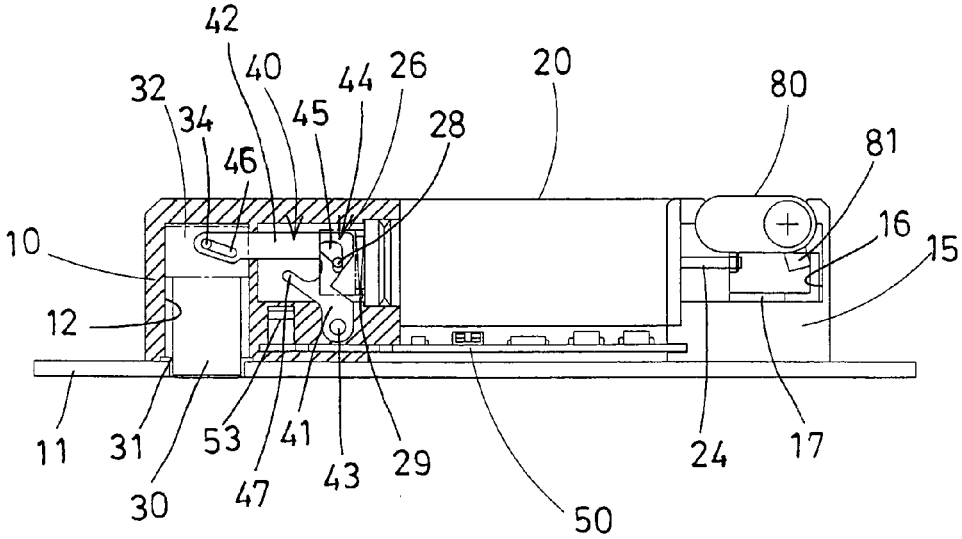
FIG. 7 is a partial cross sectional view similar to FIG. 6, illustrating the operation of the electromagnetic lock device.

The door panel 90 is typically rotatably or pivotally attached to or in a door frame 91, a lock plate 92 is normally or typically attached to the door frame 91, and includes an opening 93 formed therein for receiving a deadbolt 30 (FIGS. 1, 2) that is slidably engaged in the chamber 12 of the receptacle 10 (FIGS. 5, 6). A ring member 31 is preferably engaged or secured in the outer cover 11, to smoothly and slidably receive the deadbolt 30.

A casing 15 is also secured to the outer cover 11, and spaced away from the receptacle 10, and includes a bore 16 formed therein to slidably receive a follower 17 therein, in which the follower 17 includes a hole 18 formed in one end thereof and distal to or facing away from the casing 15. It is preferable that one or more fences 19 may further be provided (FIGS. 3, 4) and secured between the receptacle 10 and the casing 15.

A housing 20 is secured between the receptacle 10 and the casing 15, and located between the fences 19, and includes a coil 21 received in an interior or a chamber of the housing 20 (FIGS. 8–10), a plunger core 22 is slidably received in the coil 21 and the housing 20, and includes a hollow cavity 23 formed therein, for weight reducing purposes, and for allowing the plunger core 22 to be effectively actuated or moved by the coil 21.

Figure 10:
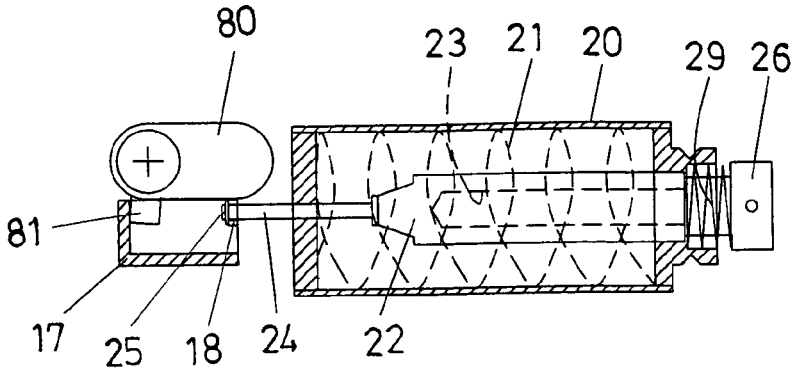
FIGS. 9, 10 are partial cross sectional views similar to FIG. 8, illustrating the operation of the electromagnetic lock device.

The plunger core 22 includes a shank 24 extended from one end thereof, and slidably engaged through the hole 18 of the follower 17, and having a locking ring or catch 25 secured to the free end of the shank 24 (FIGS. 5, and 8–10), for example, for allowing the shank 24 of the plunger core 22 to selectively slide relative to the follower 17 (FIGS. 8, 9), and thus for allowing the plunger core 22 to be moved or actuated by the coil 21 without moving or actuating the follower 17 to slide relative to the housing 20. As shown in FIG. 10, the shank 24 of the plunger core 22 may also be pulled or moved outwardly relative to the housing 20 by the follower 17 with a lock device 80 which will be discussed hereinafter.

The plunger core 22 includes an enlarged block 26 formed or provided on the other end thereof and distal or opposite to the shank 24, and includes a channel 27 formed in the other end thereof, and a pin 28 engaged into the other end thereof and extended or straddled over the channel 27 of the other end of the plunger core 22. A spring member 29 may be engaged onto the plunger core 22, and biased between the block 26 of the plunger core 22 and the housing 20, to bias or to move the plunger core 22 outwardly relative to the housing 20 (FIGS. 6, 8).

Figure 8:
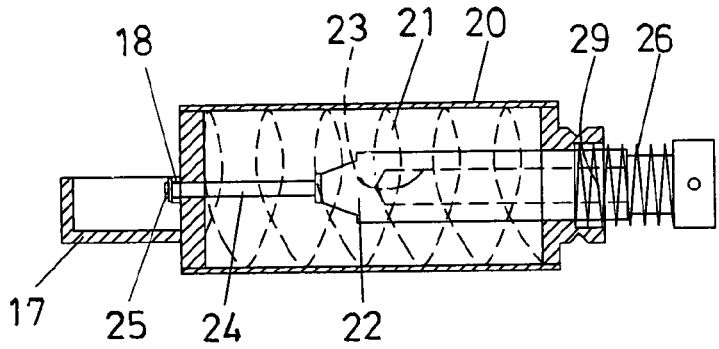
FIG. 8 is a partial cross sectional view taken along lines 8—8 of FIG. 3.
Figure 9:
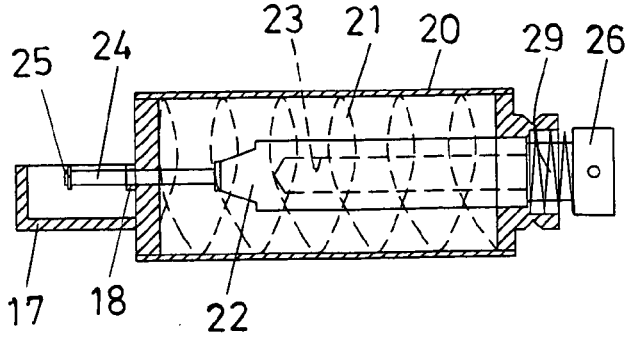
Figure 12:
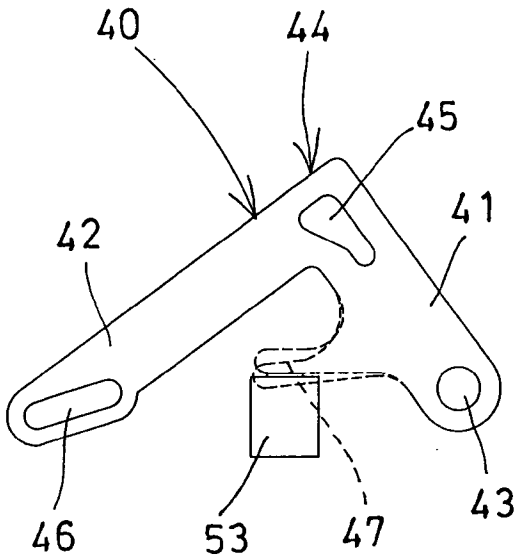
FIG. 12 is an enlarged plan view of the elbow of the electromagnetic lock device.
Figure 11:
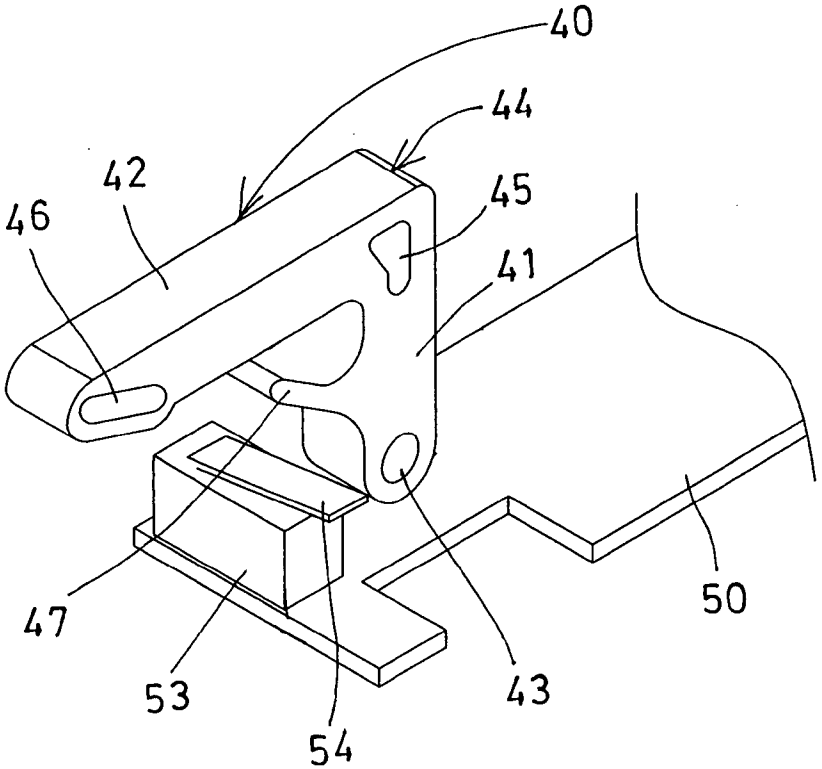
FIG. 11 is an enlarged partial perspective view showing an elbow of the electromagnetic lock device.

In operation, as shown in FIG. 9, the plunger core 22 may be moved or actuated or pulled into the housing 20, against the spring member 29, when the coil 21 is energized, and the plunger core 22 may be moved or forced out of the housing 20 by the spring member 29, as shown in FIGS. 6, 8, when the coil 21 is not energized or actuated.

As shown in FIGS. 4–6, the deadbolt 30 includes an enlarged head 32 formed or provided on an inner end thereof and slidably received in the chamber 12 of the receptacle 10, and engageable with the ring member 31, to limit the deadbolt 30 to move relative to the receptacle 10, and to prevent the deadbolt 30 from being disengaged from the receptacle 10. The deadbolt 30 includes a slot 33 formed in the inner end thereof, and a shaft 34 engaged into the inner end thereof and extended or straddled over the slot 33 of the inner end of the deadbolt 30.

An elbow 40 includes two arms 41, 42 perpendicular or inclined relative to each other, or formed or secured together to form a substantially L-shaped structure, and having one end of the arm 41 rotatably or pivotally attached or secured to the receptacle 10 with an axle 43 (FIGS. 6, 7), to allow the elbow 40 to be rotated relative to the receptacle 10, best shown in FIGS. 6, 7, 11, and 12.

The elbow 40 includes an intermediate or connecting portion 44 slidably engaged in the channel 27 of the plunger core 22, and having an irregular opening 45 formed therein, to slidably receive the pin 28, and to allow the elbow 40 to be forced to rotate relative to the receptacle 10 by the pin 28 and the plunger core 22. The other arm 42 includes an inclined or oblong hole 46 formed in the free end thereof, to slidably receive the shaft 34 of the deadbolt 30, and thus to allow the deadbolt 30 to be forced or moved out of the receptacle 10 by the plunger core 22 via the elbow 40.

As shown in FIGS. 3, 4, 6, 7, an electric circuit board 50 may be secured to the outer cover 11, or secured to the receptacle 10 or the casing 15, and may be disposed between the housing 20 and the outer cover 11, and includes a coupler 51 (FIG. 4) for coupling to electric power suppliers, and a switch 53 disposed thereon (FIGS. 6–7, 11–12), in which the switch 53 includes a pressing blade or knob 54 disposed thereon for being depressed or actuated by the elbow 40.

Figure 1:
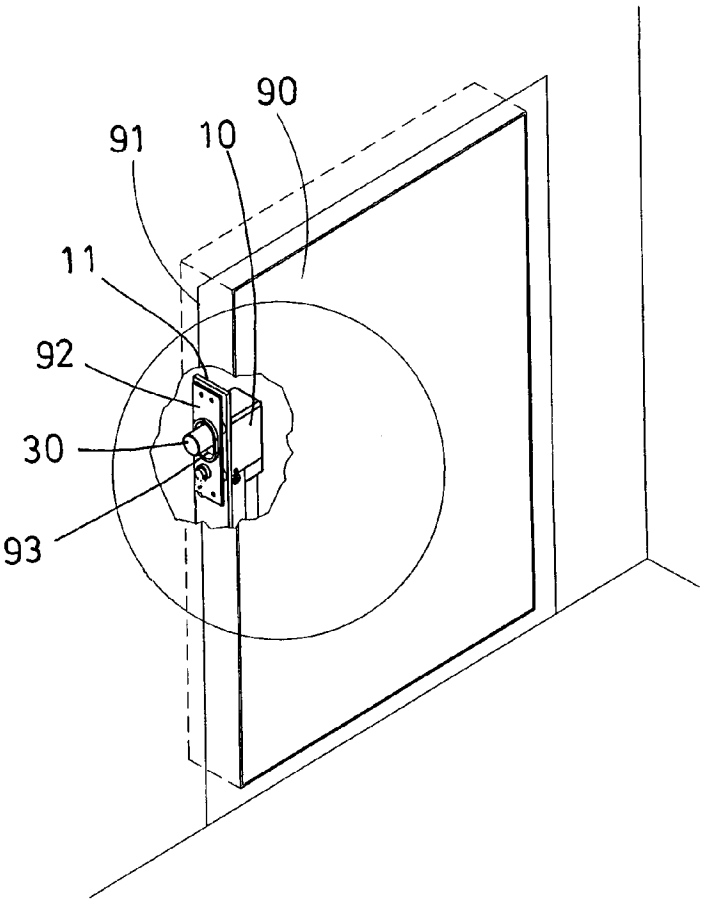
FIG. 1 is a partial perspective view illustrating an attachment of an electromagnetic lock device in accordance with the present invention to a door panel.
Figure 2:
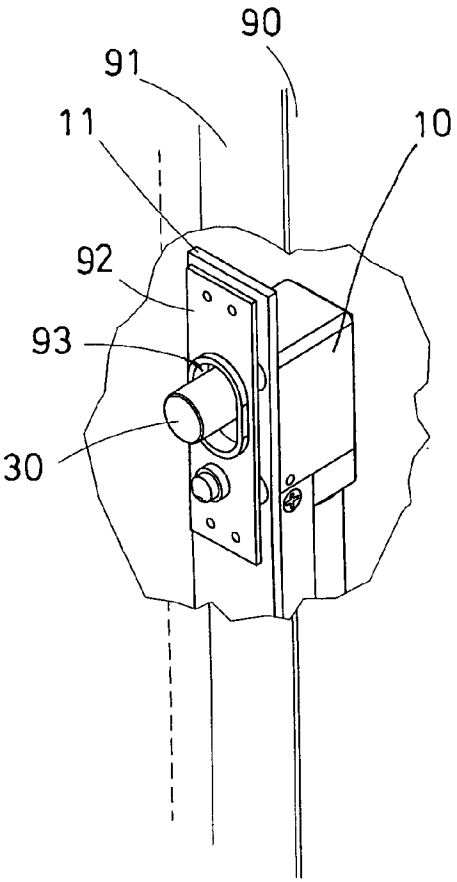
FIG. 2 is an enlarged partial perspective view of the door panel having the electromagnetic lock device in accordance with the present invention engaged therein.
Figure 3:
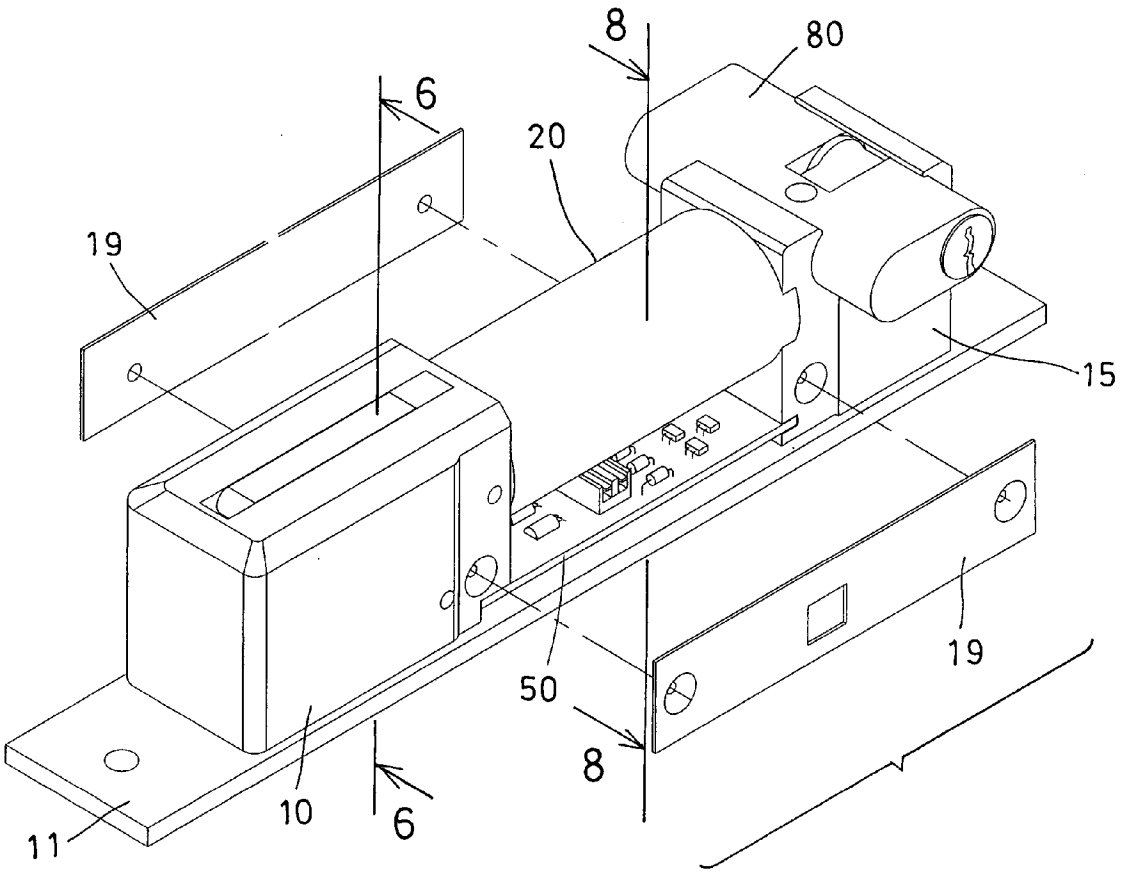
FIG. 3 is a partial exploded view of the electromagnetic lock device.

The elbow 40 includes an actuating finger 47 extended therefrom and located above or close to the knob 54 of the switch 53, for depressing or actuating the knob 54 of the switch 53, to detect or to determine whether the elbow 40 has been rotated relative to the receptacle 10 or not, and has actuated the deadbolt 30 out of the receptacle 10 and into the opening 93 of the lock plate 92 of the door frame 91 or not (FIGS. 1, 2).

In operation, as shown in FIGS. 1, 2, 6, the plunger core 22 may be biased or moved outwardly relative to the housing 20 by the spring member 29 when the coil 21 is not energized or actuated, in order to force or move the deadbolt 30 out of the receptacle 10 by the elbow 40, and to move into the opening 93 of the lock plate 92 of the door frame 91, in order to lock the door panel 90 to the door frame 91.

Figure 13:
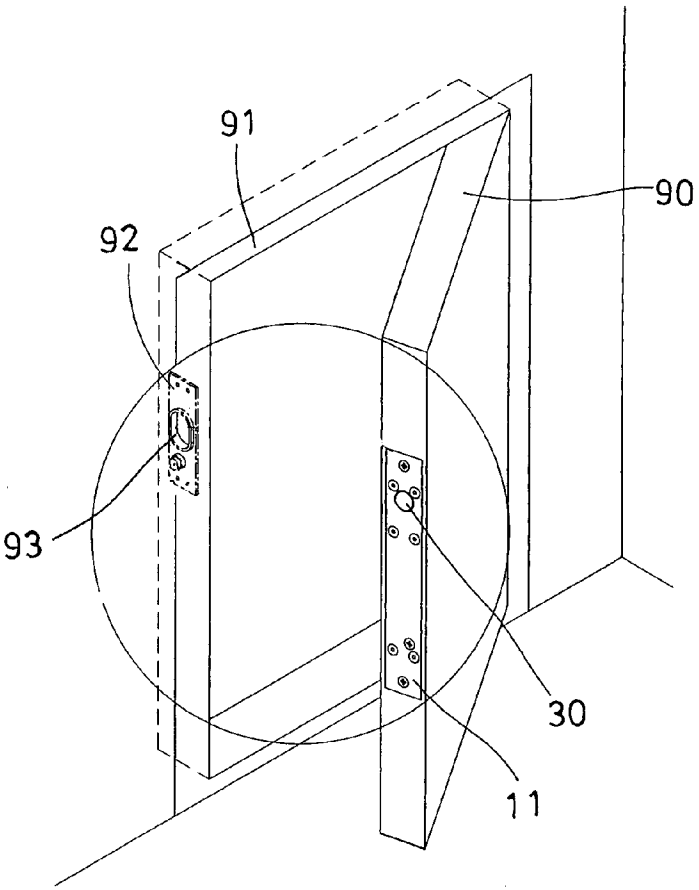
FIGS. 13, 14 are partial perspective views similar to FIGS. 1 and 2 respectively, illustrating the operation of the electromagnetic lock device.
Figure 14:
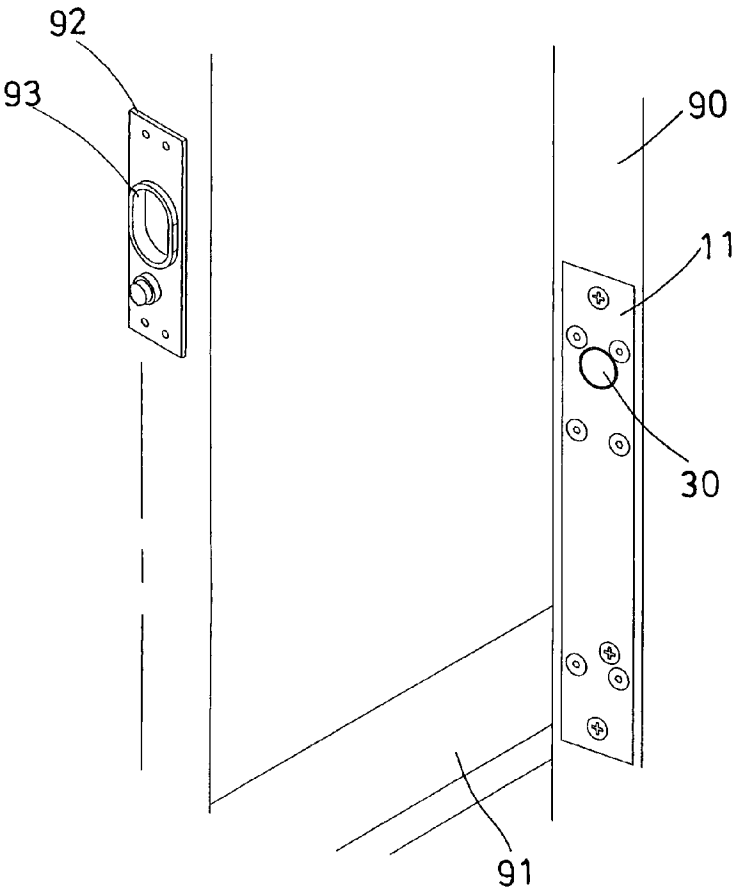

As shown in FIGS. 9, 13–14, when the coil 21 is energized, the plunger core 22 may be moved or actuated or pulled into the housing 20, against the spring member 29, in order to force or pull the deadbolt 30 into the receptacle 10 by the elbow 40, and thus to be disengaged from the opening 93 of the lock plate 92 of the door frame 91, such that the door panel 90 may be unlocked and released relative to the door frame 91.

As shown in FIGS. 3–4, 6–7 and 10, the lock device 80 may further be provided and secured to the casing 15, and includes an actuating tongue 81 extended therefrom, and engageable with the follower 17, for selectively moving the follower 17 and thus the plunger core 22 into the housing 20 (FIGS. 7, 10), and thus to pull or force the deadbolt 30 into the receptacle 10 by the elbow 40, and to unlock and release the door panel 90 from the door frame 91, such that the electromagnetic lock device may also be actuated or unlocked by the users manually with the lock device 80, in addition to the electromagnetic mechanism formed by the coil 21 and the plunger core 22.

Accordingly, the electromagnetic lock device in accordance with the present invention includes a solidly coupling mechanism to effectively actuate the deadbolt to lock the door panels.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An electromagnetic lock device comprising:

an outer cover for attaching to a door panel, a receptacle secured to said outer cover, and including a chamber formed therein, a deadbolt slidably engaged in said chamber of said receptacle, and extendible out of said receptacle, for locking the door panel to a door frame, and said deadbolt including a first end having a shaft attached thereto, a housing attached to said receptacle and including a chamber formed therein, an electromagnetic coil received in said housing, a plunger core slidably received in said electromagnetic coil and said housing, and movable and actuatable by said electromagnetic coil, and including a first end having a pin attached thereto, an elbow including a first arm and a second arm perpendicular to each other and secured together to form an L-shaped structure, and having an intermediate connecting portion, said first arm including a first end pivotally secured to said receptacle with an axle, to allow said elbow to be rotated relative to said receptacle, said elbow including an asymmetrical opening formed in said intermediate connecting portion thereof to slidably receive said pin of said plunger core, and to allow said elbow to be rotated relative to said receptacle by said plunger core, said second arm including an oblong hole formed therein to slidably receive said shaft of said deadbolt, and to allow said deadbolt to be forced to move in and out of said receptacle by said plunger core via said elbow when said elbow is rotated relative to said receptacle by said pin of said plunger core, and a spring member engaged with said plunger core, to bias said plunger core out of said housing, and to force said deadbolt to move into said receptacle when said electromagnetic coil is not energized.

2. The electromagnetic lock device as claimed in claim 1, wherein said deadbolt includes a slot formed in said first end thereof, said shaft is secured to said first end of said deadbolt, and extended through said slot of said deadbolt.

3. The electromagnetic lock device as claimed in claim 1, wherein said plunger core includes a channel formed in said first end thereof, to slidably receive said intermediate connecting portion of said elbow, said pin is secured to said first end of said plunger core, and extended through said channel of said plunger core.

4. The electromagnetic lock device as claimed in claim 1, wherein said plunger core includes a hollow cavity formed therein, for weight reducing purposes.

5. The electromagnetic lock device as claimed in claim 1 further comprising an electric circuit board attached to said receptacle, and including a switch disposed thereon, said elbow including an actuating finger extended therefrom and located close to said switch, for actuating said switch, to detect whether said elbow is rotated relative to said receptacle and to actuate said deadbolt out of said receptacle or not.

6. The electromagnetic lock device as claimed in claim 5, wherein said switch includes a pressing knob disposed thereon for being depressed by said actuating finger of said elbow.

7. The electromagnetic lock device as claimed in claim 1 further comprising a follower secured to said plunger core, and a lock device including an actuating tongue extended therefrom and engageable with said follower, for selectively moving said plunger core into said housing, and to force said deadbolt into said receptacle by said elbow.

8. The electromagnetic lock device as claimed in claim 7 further comprising a casing secured to said outer cover, said casing including a bore formed therein to slidably receive said follower therein.

* * * * *